US005834153A

United States Patent [19]

Hasegawa et al.

[11] Patent Number: 5,834,153

[45] Date of Patent: Nov. 10, 1998

[54] RADIOGRAPHIC IMAGE FORMING METHOD

[75] Inventors: Takuji Hasegawa; Hiromu Ohara, both of Hino, Japan

[73] Assignee: Konica Corporation, Japan

[21] Appl. No.: 746,740

[22] Filed: Nov. 15, 1996

[30] Foreign Application Priority Data

Nov. 20, 1995 [JP] Japan ..... 7-301331

[51] Int. Cl.[6] ..... G03C 5/17

[52] U.S. Cl. ..... 430/139; 430/966

[58] Field of Search ..... 430/139, 966; 428/690; 252/301.4 R

[56] References Cited

U.S. PATENT DOCUMENTS

| | | | |
|---|---|---|---|
| 4,839,243 | 6/1989 | Shimizu et al. | 428/690 |
| 4,865,944 | 9/1989 | Roberts et al. | 430/495 |
| 5,108,881 | 4/1992 | Dickerson et al. | 430/502 |

*Primary Examiner*—Thorl Chea

*Attorney, Agent, or Firm*—Jordan B. Bierman; Bierman, Muserlian and Lucas

[57] ABSTRACT

A radiographic image forming method is disclosed. The method comprises the steps of (1) interposing a silver halide photographic material which comprises a support having a silver halide emulsion layer on each of both sides the support and has a cross-over value of not more than 15%, between two sheets of an intensifying screen comprising a support and a fluorescent layer composed of plural fluorescent sub-layers and a protect layer provided on the support in this order from the support, in which the fluorescent sub-layers each comprises a binder and particles of a fluorescent substance having the average particle size R and the standard deviation $\sigma$ of the particle size distribution satisfying a relation of $0 < \sigma/R \leqq 0.5$ and the values of R of the particles contained in each of the fluorescent sub-layers are different from each other, (2) imagewise exposing to radiation the intensifying screens and the silver halide photographic light-sensitive material interposed between the intensifying screens, and (3) processing the imagewise exposed light-sensitive material with processing solutions including a developing solution to forming a radiographic image.

2 Claims, No Drawings

RADIOGRAPHIC IMAGE FORMING METHOD

FIELD OF THE INVENTION

This invention relates to a method for forming a radiographic image, particularly relates to a method for forming a radiographic image by which a high sensitive image formation and a high image quality can be realized.

BACKGROUND OF THE INVENTION

Recently, in the field of medical diagnosis, various kinds of electronic diagnostic devices have been introduced and images formed by such devices are used as information for diagnosis. On the other hand, a usual X-ray fluoroscopic image has still played an important role in the diagnosis, which is formed by means of a combination of a radiation intensifying screen and a silver halide photographic light-sensitive material, hereinafter simply referred to a light-sensitive material.

Although the combination of the intensifying screen and the light-sensitive material is not specified, a combination of a high light-emissive intensifying screen and a normal or high-sensitive type photographic material is usually used in the case of taking a radiographic image necessary a high-sensitive radiography, for example, taking a radiography of the lumbar vertebra, an angiography of the head and a magnifying radiography. In the high light-emissive intensifying screen, the absorbing amount of X-ray is caused by increasing the amount of fluorescent substance for increasing the emitting light amount. As a result, the fluorescent layer is thickened and a problem is raised that the sharpness of the light image emitted by the intensifying screen is degraded since scattering and reflecting of light converted from X-ray in the layer are increased accompanied with increasing in the layer thickness.

On the other hand, in the case in which the image quality is important, for example, radiographing of the chest or bone, and radiographying of the stomach with a contrast medium, a combination of high sharpness type intensifying screen and a normal sensitive light-sensitive material is usually used. In this case, problems are raised, i.e., increasing of the amount of X-ray exposure is required and the granularity of image is degraded caused by standing out the quantum noise of X-ray since the high-sharpness type intensifying screen has a low X-ray absorption ability.

Accordingly, an improvement in the image quality is demeaned in both of the case.

Although Japanese Patent Publication Open for Public Inspection (JP O.P.I.) No. 3-21898/1991 describes that both of the sharpness and granularity are improved by raising the filling density of the fluorescent substance in a radiation intensifying screen, the image quality cannot be improved sufficiently by this method. Further, JP O.P.I. No. 2-41410/1990 describes that the sharpness of image and the latitude for changing in exposure are improved by using a combination of a light-sensitive material which has emulsion layers on both side and the emulsion layers are different from each other in the photographic propertied and is composed so as to almost completely prevent the light cross-over between the emulsion layers, and intensifying screens different from each other each to be used for the front side and behind side of the light-sensitive material, respectively. However, the overall quality of the image formed by this method is insufficient since the granularity of the image is emphasized.

SUMMARY OF THE INVENTION

The present invention has been made on the above-mentioned background and the object of the invention is to provide a radiographic image forming method by which both of a high-sensitive image formation and a formation of an image with a high image quality can be realized.

The object of the invention is attained by a radiographic image forming method comprising the steps of (1) interposing a silver halide photographic material which comprises a support having a silver halide emulsion layer on each of both sides the support and has a cross-over value of not more than 15 %, between two sheets of an intensifying screen comprising a support and a fluorescent layer composed of plural fluorescent sub-layers and a protect layer provided on the support in this order from the support, in which the fluorescent sub-layers each comprises a binder and particles of a fluorescent substance having the average particle size R and the standard deviation σ of the particle size distribution satisfying a relation of $0<\sigma/R\leqq 0.5$ and the values of R of the particles contained in each of the fluorescent sub-layers are different from each other, and (2) imagewise exposing to radiation the intensifying screens and the silver halide photographic light-sensitive material interposed between the intensifying screens.

(3) processing the imagewise exposed light-sensitive material with processing solutions including a developing solution to forming a radiographic image.

It is preferred in the above method that the contrast G of an image formed by exposing to radiation a light-sensitive material interposed between two of the intensifying screen is within the range of from 1.5 to 2.2.

DETAILED DESCRIPTION OF THE INVENTION

The radiation intensifying screen to be used in the invention is one having a fluorescent layer comprising plural fluorescent sub-layers and a protective layer provided on a support, in which each of the plural fluorescent sub-layers comprises particles of a fluorescent substance having an average particle size R and a standard deviation σ of the particle size distribution satisfying relation of $0<\sigma/R\leqq 0.5$. In the invention, the plural fluorescent sub-layers means that the layers are each formed by plural coating liquids different from each other.

For perpetrating the intensifying screen, fluorescent sub-layer coating liquids are each prepared by mixing a proper amount of classified particles of a radiation fluorescent substance and a binder resin and adding a solvent to as to have an optimal viscosity according to the number of the fluorescent layers to be coated.

The fluorescent substance preferably usable in the intensifying screen includes the followings: tungustate type fluorescent substances such as $CaWO_4$, $MgWO_4$ and $CaWO_4$:Pb, terbium-activated rare-earth metal acid sulfide type fluorescent substances such as $Y_2O_2S$:Tb, Gd2$O_2$S:Tb, $La_2O_2S$:Tb, $(Y.Gd)_2O_2S$:Tb and $(Y.Gd)O_2S$:Tb.Tm, terbium-activated rare-earth metal phosphate type fluorescent substances such as $YPO_4$:Tb, $GdPO_4$:Tb, $YPO_4$:Tb and $LaPO_4$:Tb, terbium-activated rare-earth metal oxyhalide type fluorescent substances such as LaOBr:Tb, LaOBr:Tb.Tm, LaOCl:Tb, LaOCl:Tb.Tm, GdOBr:Tb and GdOCl:Tb, thulium-activated rare-earth metal oxyhalide type fluorescent substances such as LaOBr:Tm and LaOCl:Tm, barium sulfate type fluorescent substances such as $BaSO_4$:Pb, $BaSO_4$:$Eu^{2+}$ and $(Ba.Sr)SO_4$:$Eu^{2+}$, divalent europium-activated rare-earth metal phosphate type fluorescent substances such as $(Ba_2PO_4)_2$:$Eu^{2+}$, divalent europium-activated alkali-earth metal fluorohalide type fluorescent substances such as $BaFCl:Eu^{2+}$, $BaFBr:Eu^{2+}$, $BaFCl:Eu^{2+}.Tb$, $BaFBr:Eu^{2+}.Tb$, $BaF_2.BaCl.KCl:Eu^{2+}$ and $(Ba.Mg)F_2.BaCl.KCl:Eu^{2+}$, iodide type fluorescent substances such as CsI:Na, CsI:Tl and NaI.KI:Tl, sulfide type fluorescent substances such as ZnS:Ag, (Zn.Cd)S:Ag, (Zn.Cd)S:Cu and (Zn.Cd)S:Cu.Al, hafnium phosphate type fluorescent substances such as $HfP_2O_7$:Cu, tantalate type fluorescent substances such as $YTaO_4$, $YTaO_4$:Tm, $YTaO_4$:Nb, $(Y.Sr)TaO_4$:Nb, $GdTaO_4$:Tm and $Gd_2O_3.Ta_2O_5.B_2O_3$:Tb. However, the fluorescent substance usable in the invention is not limited to the above, any fluorescent substance is usable, which emits visible or near UV light.

Methods for classifying the fluorescent substance particles include a sieving method using a sieve, hydraulic elutriation method including a method of vibrating a mash bag in water in which powder of the fluorescent substance is contained and a method of pouring a coating liquid of the fluorescent substance layer on a sieve, and a precipitation method by which powder of the fluorescent substance is stirred in water and stood for a period and the top liquid of the precipitation is removed. The size distribution of the particles of the fluorescent substance can be measured by a volumetric analyzing method using a sieve or Coulter Counter, an image analyzing method using a microscope, a precipitation method using the gravity or centrifugal force, an inertia force method using a cascade impactor or a cyclone, a surface area analyzing method such as Cozeny-Carman method, an adsorption method such as BET method or an flowing method, or a method applying scattering of radiation such as a light diffraction method. As the particles of fluorescent substance for each of the fluorescent layers, ones each has an average diameter R and a standard deviation of the particle size distribution which satisfy the relation of $0>\sigma/R\geqq 0.5$, preferably $0>\sigma/R\geqq 0.3$, more preferably $0>\sigma/R\geqq 0.15$, are each prepared for each of the layers, respectively.

By using the fluorescent substance particles having a narrow size distribution described as above, the unevenness of the emitting light is reduced and the granularity of the image is improved since the fluorescent sub-layer having a high uniformity can be formed.

Binder resins usable in the coating liquid of the individual fluorescent sub-layer include polystyrene thermoplastic elastomers, polyolefin thermoplastic elastomers, polyurethane thermoplastic elastomers, polyester thermoplastic elastomers, polyamide thermoplastic elastomers, polybutadiene thermoplastic elastomers, ethylene/vinyl acetate thermoplastic elastomers, polyvinyl chloride thermoplastic elastomers, natural rubber thermoplastic elastomers, fluorized rubber thermoplastic elastomers, polyisoprene thermoplastic elastomers, polyethylene chloride thermoplastic elastomers, styrene/butadiene rubber and silicone rubber thermoplastic elastomers.

Examples of solvent usable in the fluorescent sub-layer coating liquid include lower alcohol such as methanol, ethanol, n-propanol and n-butanol, chlorine-containing hydrocarbon compounds such as methylene chloride and ethylene chloride, ketones such as acetone, methyl ethyl ketone and methyl isobutyl ketone, esters of a lower fatty acid and a lower alcohol such as methyl acetate, ethyl acetate and butyl acetate, and ethers such as dioxane, ethylene glycol monoethyl ester and ethylene glycol monomethylester, and mixtures thereof.

Examples of dispersing agent usable in the fluorescent sub-layer coating liquid include phthalic acid, stearic acid, capric acid and oleophilic surfactants.

Examples of plasticizer usable in each of the fluorescent sub-layer coating liquid include phosphates such as triphenyl phosphate, tricresyl phosphate and diphenyl phosphate, phthalates such as diethyl phthalate and dimethoxyethyl phthalate, glycol esters such as glycol ethyl phthalylethyl ester and glycol butyl phthalbutyl ester, polyesters of polyethylene glycol and di-basic fatty acid such as a polyester of triethylene glycol and adipic acid and a polyester of diethylene glycol and succinic acid.

For preparing the intensifying screen, a binder and particles of a fluorescent substance are added to an appropriate solvent and are stirred and mixed by a disper or ball mill so that the particles are uniformly dispersed in the binder to prepare a coating liquid for a fluorescent sub-layer. Further one or more coating liquids for other fluorescent sub-layers are respectively prepared in a procedure similar to that described as above. Thus obtained coating liquids are simultaneously laminated on a surface of a support to form the layers of coating liquids. The laminating process can be carried out by means of an usual coating means such as a doctor blade coater, roller coater or a knife coater. The coated sub-layers are dried by gradually heating to complete the formation of the fluorescent layer. The fluorescent layer may be formed by repeating the coating and drying of the each of the fluorescent sub-layers respectively. However, it is not essential to form the fluorescent layer by coating the coating liquids directly on the support as above-mentioned, the layers may be formed by another process. Examples of the coating methods include a method by which the sub-layers are formed by coating the coating liquids on a temporary support and drying the coated layer, and the formed laminated layers are contacted with the support by means of pressure or an adhesive.

As the support and the temporary support, for example, one made from various kinds of material such as glass, wool, cotton, paper and metal are usable, among them ones which can be made in a form of sheet or roll having a elasticity are preferred form the viewpoint of handling as a information recording material. From such the viewpoint, a plastic film such as a cellulose acetate film, polyester film, polyethylene film, polyethylene terephthalate film, polyamide film, polyimide film and polycarbonate film, metal sheets such as an aluminum foil and aluminum alloy foil, an usual paper, and a manufactured paper including a paper for photographic use, paper for printing use such as coated paper and art paper, baryta paper, resin coated paper, polysaccharide-sized paper described in Belgian Patent 784,615, pigment paper containing a pigment such as titanium dioxide and polyvinyl alcohol sized pare are particularly preferred.

The total thickness of the fluorescent sub-layers is usually 20 $\mu$m to 1 mm, preferably 50 $\mu$m to 300 $\mu$m even though the thickness may be changed according to the property of the intensifying screen to be prepared, kind of the fluorescent substance and the mixing ratio of the fluorescent substance and the binder. The kind of the fluorescent substance contained in each sub-layers may be the same or different from each other. The thickness of the individual fluorescent sub-layers may by different from each other. However, it is more preferred that the sub-layers all have the same thickness, or the thicknesses of the individual sub-layers are made so that the thicknesses of the sub-layers are increased one by one in accordance with the order of the position of the layer from the support or the thicknesses of the sub-layers are decreased one by one in accordance with the position of the layer from the support.

It is preferred that the thickness of each sub-layer is uniform so that unevenness of light emission intensity is not formed. The overall unevenness of emitting light intensity of the intensifying screen can be reduced by making uniform the thickness of the individual sub-layer. Average particle sizes of fluorescent substance each contained in the individual sub-layers may be made so that the particle sizes in the sub-layers are increased one by one in accordance with the order of the position of the sub-layers from the support or the particle sizes are decreased one by one in accordance with the order of the position of the sub-layers from the support. The sensitivity is considerably raised as well as the sharpness by making the particle sizes each contained in the individual sub-layer so as to be increased in the order of the sub-layer from the support to the protective layer. On the other hand, when the particle sizes each contained in the individual sub- layer are made so as to be decreased in the order of the position of the sub-layer from the support to the protective layer, the structural noise or structural molt of the fluorescent layer is reduced and the granularity is considerably raised since the particle size of the fluorescent substance existing near the surface of the fluorescent layer is small, which largely contributes on the light emission.

In the invention, the plural sub-layers composing the fluorescent layer of the intensifying screen each contains particles of fluorescent substance, and the values of R of the particles contained in each of the fluorescent sub-layers are different from each other. It is preferred that the average particle size of the fluorescent substance in the individual sub-layer is 10 to 20 $\mu$m in the sub-layer containing largest particles and 1 to 5 $\mu$m in the sub-layer containing smallest particles. The number of the fluorescent sub-layer is preferably 3 to 10.

It is preferred to provide a layer of a macromolecular substance such as gelatin on the surface of the support on which the fluorescent layer to be provided for making an adhesive layer so as to strengthen joining the support with the fluorescent layer. It is also preferred to provide a light reflection layer comprising a light reflecting substance such as titanium dioxide or a light absorption layer comprising a light absorbing substance such as carbon black for raising the sensitivity or image quality such as sharpness and granularity of the intensifying screen. The structure of the above-mentioned layers may be optionally selected in accordance with the object or use of the intensifying screen.

For raising the filling density of the fluorescent substance in the fluorescent layer, the fluorescent layer put on the support or coated on the support may be compressed while applying a temperature higher than the softening point or melting point of the binder of the fluorescent layer. In such the case, it is effective to adhere the fluorescent layer on the support while compressing the fluorescent layer previously prepared on a temporary support. Compressing devices usable for compressing the fluorescent layer include ones usually used such as a calender roll and hot-press. For example, the compressing treatment by means of the calender roll is carried out by passing the previously prepared fluorescent layer put on the support between rolls which are heated at a temperature higher the softening point or the melting point of the binder. However, the compressing device is not limited to the calender roll, and any one is usable which is capable of compressing the support and the fluorescent layer while heating. The pressure to be applied for compressing is preferably not less than 30 kgw/cm$^2$. The compressing may be applied after providing the protective layer.

Generally a transparent protective layer is provided on the surface opposite to the support side of the fluorescent layer for chemically and physically protecting the fluorescent layer. Such the protective layer is provided also in the intensifying screen of the invention. The thickness of the protective layer is usually within the range of from 2 to 20 $\mu$m.

The transparent protective layer can be formed by coating a coating liquid on the surface of the fluorescent layer, which is prepared by dissolving a macromolecular substance selected from a cellulose derivative such as cellulose acetate and nitrocellulose, and a synthetic macromolecular substance such as polymethyl methacrylate, polyethylene terephthalate, polyvinyl butyral, polyvinyl formal, polycarbonate, polyvinyl acetate, polyvinyl chloride and vinyl acetate copolymer in an appropriate solvent. These macromolecular substances may be used solely or in combination. When the protective layer is formed by coating, it is preferred to add a cross-linking agent to the coating liquid just before the coating thereof.

The protective layer can also be formed by adhering a separately prepared protective sheet, such as one composed of polyethylene terephthalate, polyethylene naphthalate, polyethylene or polyamide or a transparent glass plate to the surface of the fluorescent layer by means of a adhesive.

It is preferred that the protective layer is formed by a coating liquid containing an organic solvent-soluble fluororesin. The fluororesin is a polymer of a fluorine-containing olefin or fluoroolefin or a copolymer containing a fluorine-containing olefin as a component of the copolymer. The protective layer formed from a coating layer of the fluororesin may be cross-linked. The protective layer composed of the fluororesin has an advantage that dirt adhered on the surface can be easily removed by wiping since the dirt of a fatty matter caused by touching with hand or light-sensitive material or that of a plasticizer come from the light-sensitive martial is hardly penetrated in the protective layer composed of the fluororesin. The fluororesin may be mixed with another macromolecular substance for the purpose of to strengthen the protective layer.

The protective layer is preferably a layer of synthetic polymer formed on the fluorescent layer, which has a thickness of not more than 10 $\mu$m. The use of such the thin protective layer contributes to improving in the sharpness of the formed image since the distance from the fluorescent layer to the light-sensitive material is made short.

In the invention, a radiographic image is taken by a combination of the above-mentioned radiation intensifying screen and a light-sensitive material which has two emulsion layers on both sides thereof and has the cross-over ratio of the intensifying screen is not more than 15%.

In a light-sensitive material having emulsion layers on the both sided thereof, degradation in the image caused cross-over light tend to occur. The cross-over light is visible light emitted from a fluorescent layer superposed with an emulsion surface of a light-sensitive material and reached at another emulsion layer provided on the opposite side of the light-sensitive material after penetrating through the support of the light-sensitive material. The cross-over light causes considerably degradation in the image quality, particularly in the sharpness. For reducing the cross-over light, for example, the technique described in U.S. Pat. Nos. 4,425,425 and 4,425,426 using a silver halide emulsion comprised of spectrally sensitized tabular silver halide grains having a high aspect ratio or the technique described in U.S. Pat. No. 4.803,150 by which a layer containing micro crystalline dye capable of decoloring by processing is provided between the support and the emulsion layer of a light-sensitive material, can be applied.

The cross-over ratio in % in the present invention is determined in the following procedure:

1) The fluorescent surface of a radiation intensifying screen is contacted with a surface of a silver halide light-sensitive material to be determined which has emulsion layers on the both sides thereof, and the light-sensitive material and the intensifying screen contacted with the light-sensitive material are shielded from light by a sheet of black paper.
2) X-ray is irradiated to the light-sensitive material through the intensifying screen. The irradiated amount of X-ray is changed stepwise by varying the distance from the focal spot of the X-ray generating apparatus to the intensifying screen.
3) After the irradiation by X-ray, the light-sensitive material is separated from the intensifying screen and is processed.
4) Then the processed light-sensitive material is divided to two parts. The emulsion layer which has been contacted with the intensifying screen was removed from one of the divided parts of the light-sensitive material. And the emulsion layer on the opposite side of the light-sensitive material is removed from the other part of the light-sensitive material.
5) Characteristic curves of each of the emulsion layer remained on the individual parts of the light-sensitive material are drawn and the average of the difference of the sensitivities of the above two emulsion layers Δlog E is measured base on the linear portion of the characteristic curves.
6) the cross-over ratio in percent is determined by the following equation:

$$\text{Cross-over } (\%)100/\text{antilog}(\Delta\log E)+1$$

A typical light-sensitive material of the invention is constituted by a blue-tinted transparent support, and a subbing layer, a dye layer for reducing cross-over light which are provided according to necessity, at least one silver emulsion layer and a protective layer each provided on the both sides of the support in this order from the support, respectively. It is preferred that each of the layers provided on both sides of the support are the same, respectively.

The support is one made from a transparent material such as polyethylene terephthalate. As the blue dye, ones usually used for tinting the support for a X-ray film such as anthraquinone dyes may be used. The thickness of the support is optionally selected from within the range of from 80 to 200 μm. A subbing layer composed of a water-soluble macromolecular substance such as gelatin is provided on the surface of the support similarly in an usual X-ray film.

A dye layer is provided on the subbing layer for reducing cross-over light according to necessity. The dye is usually formed as a layer of a colloid containing a dye. It is preferred that the dye is fixed in the dye layer and is not diffused out to the silver halide emulsion layer or the protective layer provided at the upper position.

Various methods have been known for improving the discoloring property of the dye or for fixing the dye in the dye-containing layer or the protective layer. Such the methods include, for example, a method using a combination of cationic mordant and an anionic dye described in EP No. 211273B1, a method using a combination of an anionic dye and a polymer dispersion usable as a mordant which is prepared by polymerization of an unsaturated ethylene monomer having an anionic functional group and a cationic mordant described in JP O.).I. No. 2-207242 and a method using a dye in a form of solid crystal or microcrystalline dye particles described in U.S. Pat. No. 4,803,150. Among these methods, the method using the solid microcrystalline dye is preferred. The above-mentioned dye is effective to reduce the cross-over ration by 15% or less.

When the combination of a cationic mordant and an anionic dye is used in the dye layer, the followings are described as examples of the anionic dye.

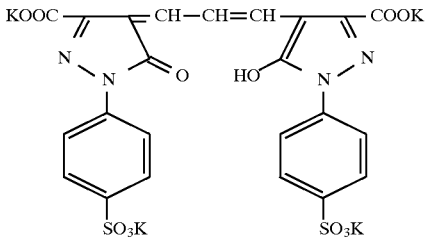

(a)

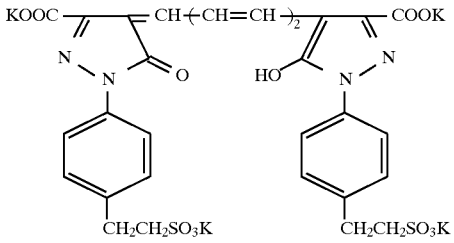

(b)

-continued
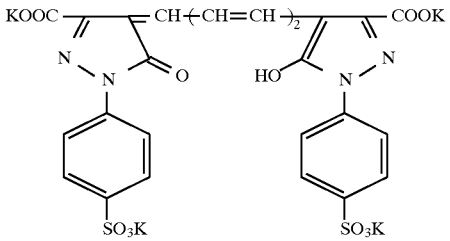
(c)
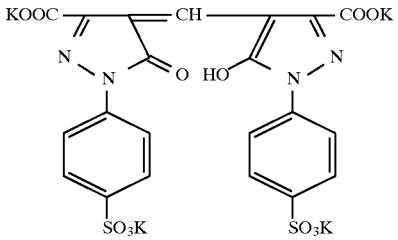
(d)
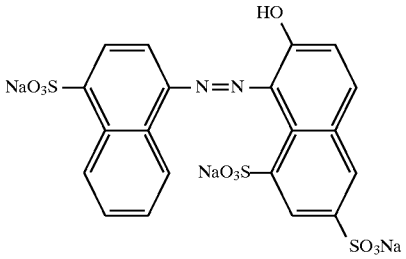
(e)
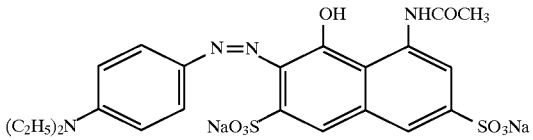
(f)
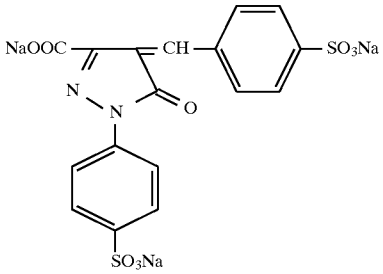
(g)
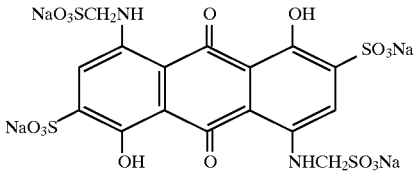
(h)
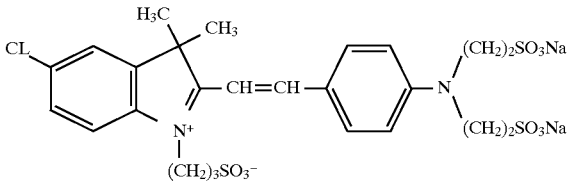
(i)

-continued
(j)
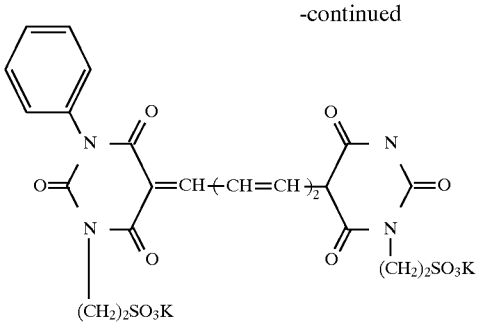
(k)
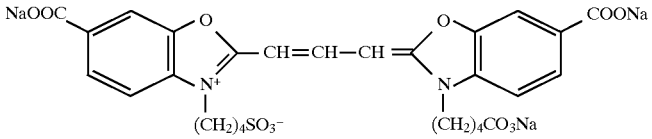
(l)
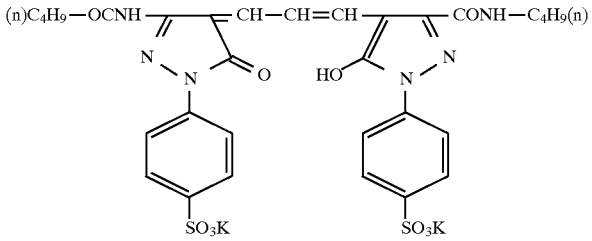
(m)
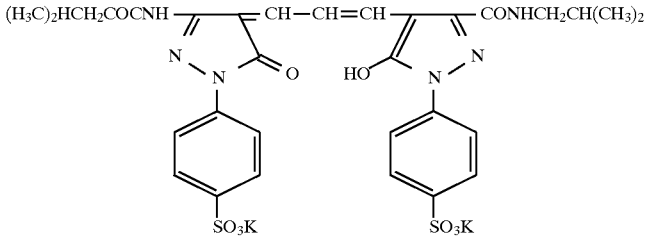
(n)
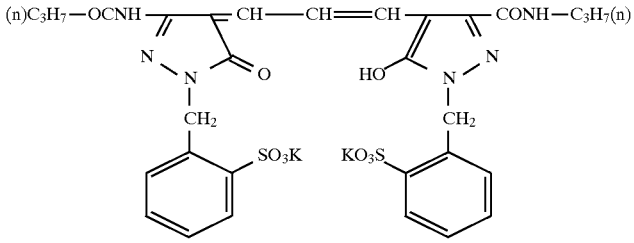
(o)
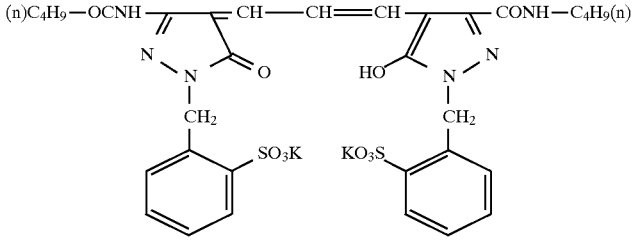
When the dye is used in the dye layer in a form of solid dispersion of microcrystalline of the dye, the followings are described as examples of dye.

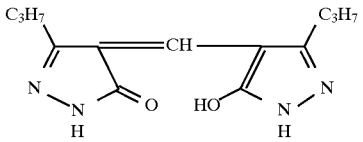
(AH-1)
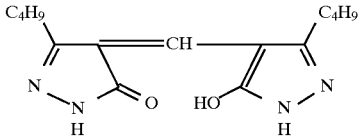
(AH-2)
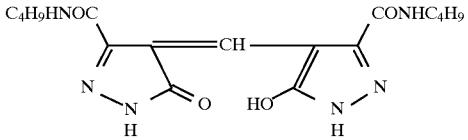
(AH-3)
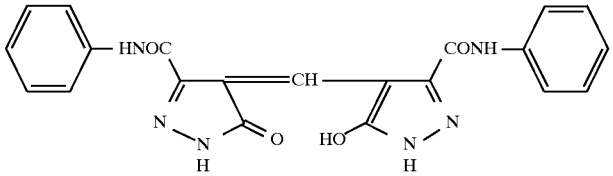
(AH-4)
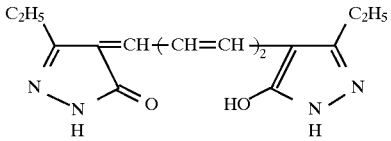
(AH-5)
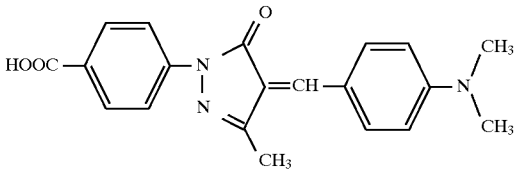
(AH-6)
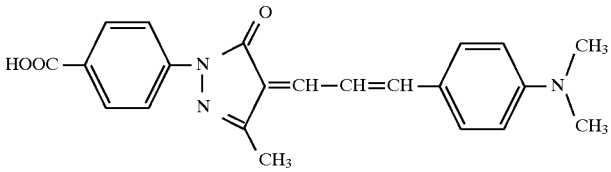
(AH-7)
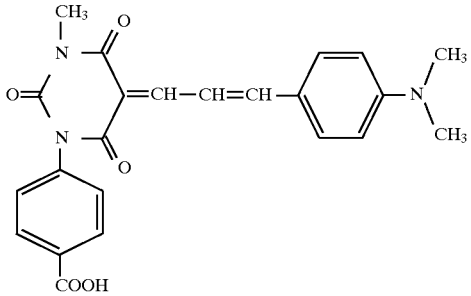
(AH-8)

-continued
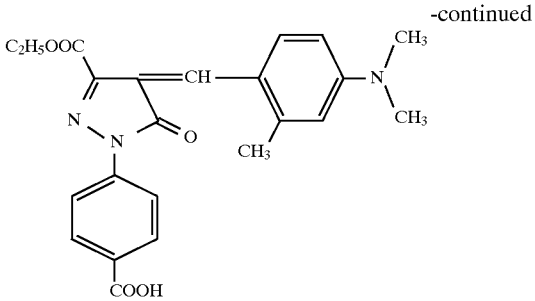
(AH-9)
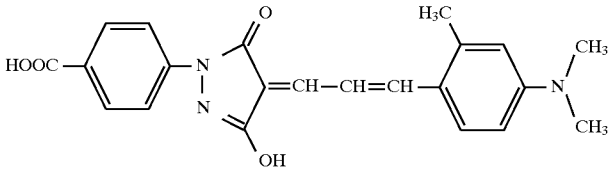
(AH-10)
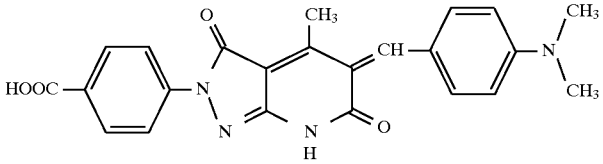
(AH-11)
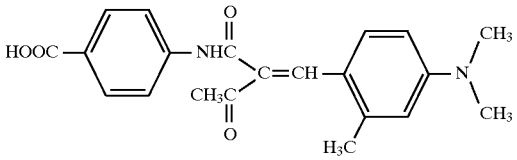
(AH-12)
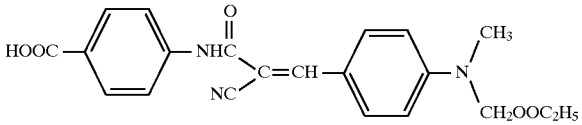
(AH-13)
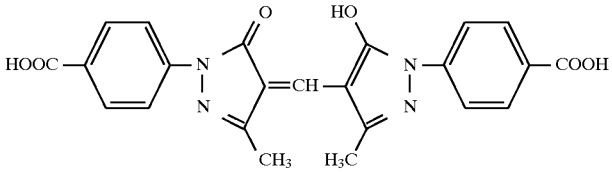
(AH-14)
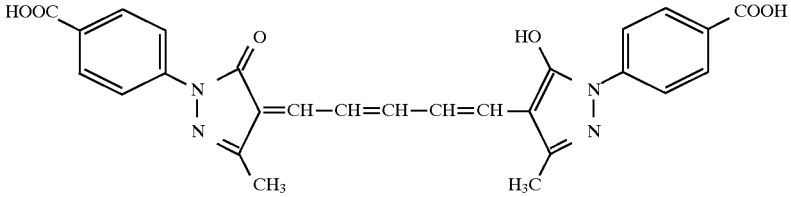
(AH-15)
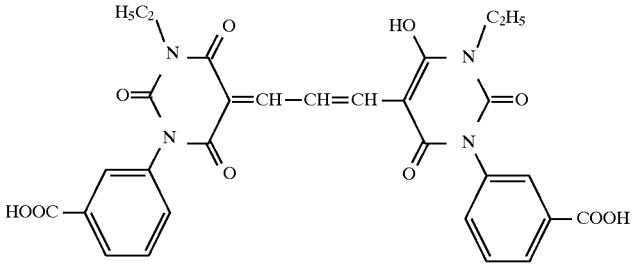
(AH-16)

-continued

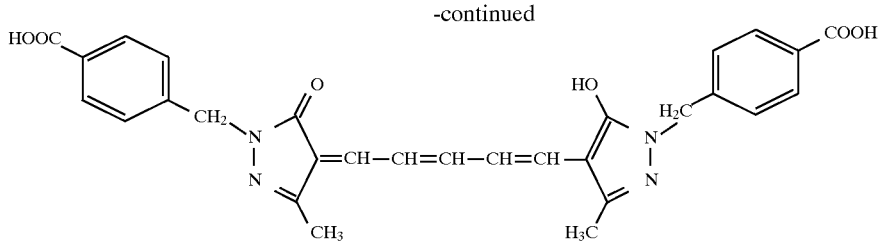

(AH-17)

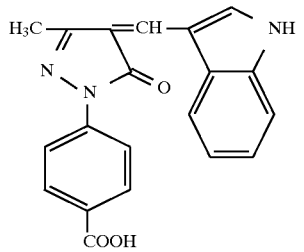

(AH-18)

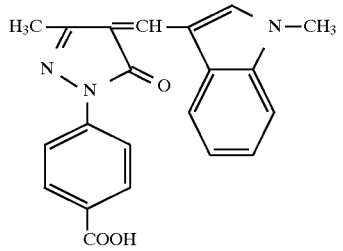

(HA-19 )

In the invention, the contrast G of the light-sensitive material is determined by the slope of a straight line connecting a density point of (fog+0.25) and a density point of (fog+0.2) on the photographic characteristic curve of the light-sensitive material which is obtained by the following procedure:

Both surfaces of a light-sensitive material to be determined are each contacted with the same kind of radiation intensifying screens, respectively, and exposed to X-ray generated by a tube potential of 100 kV for 50 m sec. The exposure amount of X-ray is changed stepwise by a distance varying method The light-sensitive-material thus exposed is processed and is subjected to densitometry to draw the characteristic curve.

As the silver halide emulsion to be used in the light-sensitive material of the invention, both of an emulsion composed of regular crystal silver halide grains and that composed of silver halide grains may be used. Among them the tabular grains are preferably used.

The emulsion composed of the tabular silver halide grains is one in which the average aspect ratio, average of the aspect ratio or the ratio of grain diameter/grain thickness, of the silver halide grains contained in the emulsion is not less than 2, preferably 2.5 to 30, more preferably 3 to 20, and particularly preferably 4 to 15.

The average thickness of the grains is usually not more than 0.40 μm, preferably not more than 0.3 μm, particularly not more than 0.05 μm to 0.25 μm.

As the emulsion, an iodobromide emulsion or a chloroiodobromide emulsion each having an average iodide content of 0 to 1.0 mole-%, preferably 0.1 to 0.8 mole-%, is preferred. In the case of the chloroiodobromide emulsion, the silver chloride content is preferably 0 to 20 mole-%, more preferably 0 to 12 mole-%. It is preferred that the sum of the projection area of the silver iodobromide grains or silver chloroiodobromide grains accounts for not less than 50%, more preferably not less than 70%, of the total projection area of silver halide grains contained in the emulsion. Further it is preferred that the sum of the projection area of the hexagonal tabular silver halide grains accounts not lees than 70% of the total projection are contained in the emulsion. The hexagonal tabular silver halide grains each has a ratio of the length of the longest side to that of the shortest side of not more than 2.0 and has two parallel plane as the outer surfaces. The grain size distribution of the tabular grains is preferably monodisperse.

The silver halide composition of the inner portion of the silver halide grain may be not uniform, and the inner portion of the grain having a volume of ½ of the total volume of the grain may contain 0 mole-% to the upper limit of solid solubility of silver iodide and 0 to 30 mole-% of silver chloride. The grain may have a layered structure in which the outer portion of the grain having a volume of ½ of the total volume of the grain contains 0 mole-% to the upper limit of solid solubility of silver iodide and 0 to 30 mole-% of silver chloride.

The diameter of the projection area of the tabular grain in the silver halide emulsion is usually 0.2 to 2.0 μm, preferably 0.3 to 1.5 μm.

When the emulsion is principally composed of the hexagonal tabular silver halide grains, the average silver chloride content of the grains is preferably not more than 1.0 mole-% from the viewpoint of the rapid processing adaptability and fixing property of the emulsion.

It is preferred that in the light-sensitive material to be used in the invention that the average silver chloride content does not exceed to 20 mole-% for obtaining a sufficient photographic properties by means of the usual automatic processor system for medical use. When the silver chloride content exceeds 20 mole-%, fogging and fluctuation in the photographic properties depending on the difference of processing system of the light-sensitive material are tend to increase.

In the light-sensitive material to be used in the invention, an emulsion containing silver halide grains in which the silver iodide distribution is varied such as described in JP O.P.I. Nos. 59-99433/1984, 60-147727/1985, 63-92942/1988, 1-152446/1989, 2-12142/1990, 2-28638/1990 and 4-1074421992 can be used. In the light-sensitive material to be used in the invention, a monodispersed emulsion described in JP O.P.I. Nos. 63-151618/1988, 1-213639/1989 and 3-63433/1991, can also be used. Further in the light-sensitive material, silver halide grains described in JP O.P.I. No. 63-305343/1988 in each of which development initiation points are concentrated at a specific portion of the grain, silver halide grains each including a dislocation line described in JP O.P.I. Nos. 63-220238/1988, 1-201649/1989 and 3-175440/1991 or silver halide grains each having a layered structure described in JP O.P.I. Nos. 1-279237/1989 and 1-273039/1989 may be used.

The preferable tabular grain is one obtained by an ordinary preparing method and has an aspect ratio of not more than 10 and a ratio (b/a) of the grain thickness (b) to the distance between twin surfaces (a) of not less than 5.

Here, the thickness of grain is a distance between the two major faces of a tabular grain facing to each other, i.e., the shortest distance of the line passed through the gravity center of the grain. The thickness of grain can be measured by diagonally observation by an electron microscope.

The silver halide grains to be used in the light-sensitive material of the invention is preferably monodisperse grains. The "monodisperse emulsion" is an emulsion having a distribution width of size of the grains of the emulsion is not more than 30%, preferably not more than 20%. The width of the grain size distribution is defined by the following equation.

Distribution width (%)= (Standard deviation of grain diameter x average grain diameter) x 100

In the above, the diameter of grain is measured according to the foregoing description and the average diameter is a simple average of the grain diameter.

Average diameter$=\Sigma d_i n_i/\Sigma n_i$

In the equation, $d_i n_i$ is a number of grains having a diameter of $n_i$.

Known methods may be applied for obtaining the tabular grain emulsion. For example, a method by which an aqueous solution of silver nitrate and an aqueous solution of halide are poured to a solution containing gelatin and seed grains by a double-jet method may be applied. In such the method, the diameter, thickness, distribution of diameter or thickness, aspect ration and the photographic properties of the grains can be optionally controlled by controlling the pH value, amount of seed grains and halide composition.

The monodisperse emulsion may also be prepared by known methods, for example, a method by which a silver nitrate aqueous solution and a halide aqueous solution are added to a gelatin solution containing seed grains by a double-jet method while controlling the pH and pAg values. The adding rates of the solutions in the above method can be decided referring JP O.P.I. Nos. 54-48521/1979 and 58-49938/1983. The silver halide grains may be prepared by the method described in JP O.P.I. No. 3-213845/1991 by which fine silver halide grains were supplied as the source of silver.

Another types of the silver halide grains prepserably usable in the invention includes a grain of regular crystal having an average diameter of not more than 0.40 $\mu$m. The crystal habit of the grain may be cubic, tetradecahedral, regular octahedral or sphere. The grains may not be tabular grains when the grains are silver chloroiodobromide having a iodide content of not more than 1.0 mol-% and the average diameter is not more than 40 $\mu$m. In a trigger type light-sensitive material, fine silver halide grains each having an internal fog nucleu, may be mixed with the the above-mentioned silver halide grains. A layer containing fine silver halide grains on which a dye is adsorbed may be provided under the tabular grain emulsion layer for cutting cross-over light or halation light.

Such the fine grains may be prepared by a well known method.

A washing method such as a noodle washing method or flocculation method may be applied to the emulsion to remove water-soluble salts contained in the emulsion. As the washing method, the method using a sulfo group-containing aromatic hydrocarbon aldehyde resin described in JP 35-16086/1978 and the method using a macromolecular coagulant G3 or G6 described in JP O.P.I. No. 2-7037/1990 are preferably used.

Various kinds of additives may be added to the emulsion in the course of preparation including the physical ripening and chemical ripening and after the ripening. The additives include, for example, compounds described in Research Disclosure Nos. 17643 (December 1978), 18716 (November 1979) and 308119 (December 1989).

The support usable in the light-sensitive material relating to the invention includes those described in Research Disclosure No. 17643, page 28, and No. 308119, page 1009. A preferable support is polyethylene terephthalate film. The surface of the support may be subjected to providing a subbing layer or a treatment by corona discharge or UV irradiation for improving an adhesiveness with the layer coated thereon.

The coating amount of silver halide in the light-sensitive material to be used in the invention is preferably not more than 3.3 g/m$^2$ and not less than 1.2 g/M$^2$ per one side of the support in terms of silver.

Developing agents usable for developing the light-sensitive material include dihydroxybenzenes such as hydroquinone, paraminophenols such as p-aminophenol, N-methyl-p-aminophenol and 2,4,-diaminophenol, 3-pyrazolidones such as 1-phenyl-3-pyrazolidone, 1-phenyl-4-methyl-4-hydroxyphenyl-3-pyrazolidone and 5,5-dimethyl-1-phenyl-3-pyrazolidone. It is preferred that these developing agents are used in combination.

The using amount of the above-mentioned paraminophenols is preferably not less than 0.004 moles, more preferably, 0.04 to 0.12 moles, per liter of the developer. The using amount of the 3-aminopyrazolidones is preferably 0.001 to 0.1 moles, more preferably 0.005 to 0.05 moles per liter. The total amount of the developing agents contained in the developer is preferably not more than 0.1 moles per liter.

Although an aldehyde hardener such as glutaraldehyde is usually used in the developer for the purpose of raising the processing ability without decreasing in the sensitivity of the light-sensitive material, it is preferred to use no aldehyde compound since the stench of the compound causes deterioration of the working environment.

The developer may contain sulfites such as potassium sulfite and sodium sulfite, reductones such as piperydinohexsose reductone as a preservative. These compound are each used preferably in an amount of 0.2 to 1 moles, more preferably 0.3 to 0.6 moles, per liter. Addition of a large amount of ascorbic acid is also effective for realizing a stable processing.

The developer may contain an alkaline agent such as sodium hydroxide, potassium hydroxide, sodium carbonate, potassium carbonate, trisodium phosphate or tripotassium phosphate. The developer further may contain a buffering agent such as boric acid described in JP O.P.I. No. 61-28708/1986, saccharose described in JP O.P.I. No. 60-93439/1985, acetoxime, 5-sulfosalicilic acid, phosphate or carbonate. The contents of these agents are decided so that the pH value of the developer is within the range of 9.0 to 13, preferably 10 to 12.5. The developer may further contain a dissolving aid selected from polyethylene glycols and their esters, a sensitizer such as a quartenary ammonium salt, a developing accelerating agent and a surfactant.

As silver sludge inhibiting agents, sulfide and disulfide compounds described in JP O.P.I. Nos. 56-106244/1981 and 3-51844, cystine compound described in JP O.P.I. No. 5-289255/1993 and triazine compounds are usable. As organic fog inhibitors, for example, indazoles, imidazoles, benzimidazoles, triazoles, benzotriazoles, tetrazoles and dihydroxybenzenes may be used. As inorganic fog inhibitor, sodium bromide, potassium bromide or potassium iodide may be contained in the developer. Further, compounds described in L. F. A. Menson, "Photographic Processing Chemistry" p.p. 226–229, Focal Press, 1966, U.S. Pat. Nos. 2,193,015, and 2,592,364, and JP O.P.I. No. 48-64933 are usable. As chelating agents for hiding calcium ions contained in city water to be used for the developing solution, organic chelating agents each having a chelate stability constant of not less than 8 are usable, which are described in JP O.P.I. No. 1-193853/1989. Usable inorganic chelating agents include sodium hexametaphosphate, calcium hexametaphosphate and polyphosphates are also usable.

The developing temperature is preferably 25° to 50° C., more preferably 30° to 40° C. The developing time is preferably 5 to 90 seconds, more preferably 8 to 60 seconds. Processing time for dry to dry is preferably 15 to 220 seconds, more preferably 20 to 90 seconds.

A replenishing solution for the developer is preferably one having compositions similar to those of the developer. The replenisher is replenished in an amount necessary to recover the fatigue of the developer caused by processing and oxidation. The replenishing amount of a fixing replenisher is preferably not more than 300 ml, more preferably 50 to 300 ml, further preferably 60 to 190 ml, per $m^2$ of the light-sensitive material processed.

A fixing solution may be used which is recovered by an ion-exchange method, treatment by an apparatus for removing silver ions and halogen ions byan electrolysis, or by replenishing a fixing agent principally.

The pH value of the fixing solution is preferably not less than 3.8, more preferably 4.2 to 5.5. Fixing agents include thiosulfates such as ammonium thiosulfate and sodium thiosulfate. Ammonium thiosulfate is particularly preferred from the viewpoint of fixing rate.

Water-soluble aluminum salts are known as compounds functioning as a hardener in the fixing solution. The aluminum salts include aluminum chloride and aluminum alum. However, it is preferred that the fixing solution contains no aluminum compound when the replenishing amount in the processing is small because the aluminum ions of the hardener is tend to be precipitated in a form of aluminum hydroxide which causes degradation of fixing ability of the fixing solution. When the aluminum compound is necessary, it is preferred that the pH value of the fixing solution is not exceed 5.0.

The fixing solution may contain, according to necessity, a preservant such as sulfites and bisulfates, a buffering agent such as acetic acid, nitric acid and boric acid, a pH controlling agent such as sulfuric acid and sodium hydroxide, and a chelating agent having a water softening ability. An anionic surfactant such as sulfuric acid ester-containing compounds and sulfonic acid-containing compounds, a nonionic surfactant such as polyethylene glycol compounds and ester compounds, or an amphoteric surfactant such as those described in JP O.P.I. No. 57-6840/1982 may be contained in the fixing solution as a surfactant. Further, alkanolamine and alkylene glycol may be used in the fixing solution.

Thiourea derivatives described in JP Nos. 45-35754/1970, 58-122535/1983 and 58-122536/1983, and thioethers described in U.S. Pat. No. 4,126,459 may be used as fixing accelerating agents.

It is preferred that the fixing solution replenisher has compositions similar to those of the fixing solution.

EXAMPLE

<Preparation of radiation intensifying screen>

Radiation intensifying screen No. 1 to No. 5 were prepared in the following manner. The screens were prepared each two sheets for the respective samples.

A fluorescent substance of $Gd_2O_2S$:Tb was classified by hydraulic elutriation, so various kinds of specimens were prepared each of which has the average particle diameter R, the standard deviation of the particle diameter distribution σ and the ratio of them σ/R described in the following table, respectively. Coating liquids each containing the respective specimen of the fluorescent substance were prepared in the following manner. In a ball mill, 200 g of one of the specimen of fluorescent substance of is mixed for six hours with 10 g of polyurethane and 50 g of methyl ethyl ketone to prepare a fluorescent substance coating liquid.

The coating liquids were laminated on a polyethylene terephthalate support having a thickness of 250 μm set on a glass plate by a knife coater in the order of first, second and third layer from the support as shown in the following table to prepare a fluorescent layer. Then a polyethylene terephthalate film with a thickness of 3 μm having a transparent polyester adhesive layer on one side thereof is superposed and adhered on the fluorescent layer through the adhesive layer of the film to form a protective layer. Thus intensifying screens No. 1 to No. 5 were prepared. Each of the screen has the structure given in the following table. In the table, d is the thickness of the layer in μm.

TABLE 1

| Screen | First layer | | | | Second layer | | | | Third layer | | | |
|---|---|---|---|---|---|---|---|---|---|---|---|---|
| No. | R | σ | σ/R | d | R | σ | σ/R | d | R | σ | σ/R | d |
| 1 (Comp) | 2.4 | 1.71 | 0.71 | 40 | 7.8 | 5.40 | 0.69 | 40 | 14.9 | 9.89 | 0.66 | 40 |
| 2 (Inv.) | 2.4 | 0.93 | 0.39 | 40 | 7.8 | 3.57 | 0.46 | 40 | 14.9 | 5.19 | 0.35 | 40 |
| 3 (Inv.) | 2.4 | 0.29 | 0.12 | 40 | 7.8 | 1.21 | 0.16 | 40 | 14.9 | 1.72 | 0.12 | 40 |
| 4 (Inv.) | 2.4 | 0.29 | 0.12 | 60 | 14.9 | 1.72 | 0.12 | 60 | — | — | — | — |
| 5 (Inv.) | 14.9 | 1.72 | 0.12 | 40 | 7.8 | 5.40 | 0.69 | 40 | 2.4 | 0.29 | 0.12 | 40 |

<Preparation of light-sensitive material>

Preparation of Emulsion A

An aqueous solution of 8.33 g of silver nitrate and an aqueous solution of 5.94 g of potassium bromide and 0.726 g of potassium iodide were added while stirring by a double-jet method for 45 seconds to a solution maintained at 76° C. which composed of 1 liter of water, 0.05 g of potassium iodide, 30 g of gelatin, 4.0 ml of 5% aqueous solution of thioether, $HO(CH_2)_2S(CH_2)_2OH$.

Then 2.5 g of potassium bromide was added. After addition of potassium bromide, an aqueous solution of 8.33 g of silver nitrate was added spending for 26 minutes. The adding rate of the silver nitrate solution was controlled so that the flow rate at the time of the completion of the addition was 2 times of the flow rate at the initial time of the addition. Thus formed emulsion was subjected to physical ripening for 20 minutes after addition of 20 ml of 25% ammonia solution and 10 ml of 50% aqueous solution of ammonium nitrate. The emulsion was neutralized by adding 15 ml of glacial acetic acid. Then an aqueous solution of 153.34 g of silver nitrate and an aqueous solution of 107 g of potassium bromide were added to the emulsion spending for 40 minutes by a controlled double-jet method while maintaining the pAg value at 8.2. In the course of the addition, the flow rate of the solutions were each controlled so that the flow rate at the time of the completion of addition is 9 times of that at the initial time of the addition. At the completion time of the addition, 15 ml of 2N-potassium thiocyanate solution and 25 ml of a 1% aqueous solution of potassium iodide were further added to the emulsion.

After that, the temperature of the emulsion was lowered by 35° C. and water soluble salt was removed from the emulsion by a precipitation method. The temperature of the emulsion was raised by 40° C. and 30 g of gelatin, 2 g of phenol were added, and the pH and pAg of the emulsion were each adjusted to 6.40 and 8.50, respectively, by using sodium hydroxide and potassium bromide. After raising the temperature of the emulsion to 56° C., 520 mg of a sensitizing dye A and a stabilizer A each having the following structures were added to the emulsion. Ten minutes after the addition of the dye and the stabilizer, 2.4 g of sodium thiosulfate pentahydrate, 140 mg of potassium thiocyanate and 2.1 mg of chloroauric acid were added to the emulsion and the emulsion was stand for 80 minutes. After 80 minutes, the emulsion was set by rapidly cooling.

Sensitizing dye A

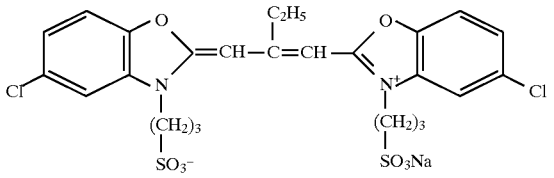

Stabilizer A

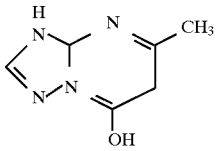

In thus obtained emulsion, sum of the projection are of silver halide grains each having an aspect ratio of not less than 3 accounts for 98% of the total projection area of all silver halide grains contained in the emulsion. The silver halide grains having an aspect ratio of not less than 3 has an average projection area diameter of 1.8 μm, a standard deviation of the diameter of 24%, an average thickness of 0.2 μm, and an average value of the aspect ratio of 9.0.

Preparation of Emulsion B

Emulsion B was prepared in the same manner as in Emulsion A except that the amount of 5% aqueous solution of thioether was 2.4 ml and the temperature in the grain formation period was 69° C. An average projection area diameter of the grains each having an aspect ratio of not less than 3 was 1.2 μm, and the standard deviation of the grain diameter distribution and average aspect ratio of these grains were each 15% and 7.1, respectively.

Preparation of Emulsion C

Emulsion C was prepared in the same manner as in Emulsion B except that the amount of 5% aqueous solution of thioether was 2.0 ml and the temperature at the grain formation time was 66° C., the adding amount of 25% ammonia solution was 15 ml, the amount of glacial acetic acid was 11.5 ml, the amount of sensitizing dye A was 600 mg, the amount of sodium thiosulfate pentahydrate was 3.1 g and the amount of chloroauric acid was 2.8 mg. An average projection area diameter of the grains each having an aspect ratio of not less than 3 was 1.0 μm, and the standard deviation of the grain diameter distribution and average aspect ratio of these grains were each 15% and 7.0, respectively.

Preparation of emulsion layer coating liquid 1

Emulsions A and B were mixed in a ratio of 1:1, and the following compounds were each added in the following amount per mole of silver halide to the mixed emulsion to prepare a coating liquid.

| | |
|---|---|
| Gelatin | An amount necessary to make the ratio of silver halide to the total amount of gelatin Ag/Gel to be 1.0 |
| Polymer latex | 25 g |
| Polyethyl acrylate/methacrylic acid-1,2-bis(suolfonylacetoamido) ethane, | 8 milimoles per 100 g of gelatin contained in the emulsion layer and surface protective layer in total |
| (ethyl methacrylate:methacrylic acid = 97:3) | |
| Potassium hydroquinonemonosulfonate | 12 g |
| 2,6-bis(hydroxyamino)-4-diethylamino-1,3,5-triazine | 80 mg |
| Sodium polyacrylate (weight average molecular weight 41,000) | 4.0 g |
| Sodium polystyrenesulfonate (weight average molecular weight 600,000) | 1.0 g |

Preparation of emulsion layer coating liquid 2

Emulsion coating liquid 2 was prepared in the same manner as in Emulsion coating liquid 1 except that the emulsion was replace by Emulsion C.

Preparation of Protective layer coating liquid

A protective layer coating layer was prepared according to the following receipt so that the coating amount per $m^2$ of each composition was as follows:

| | |
|---|---|
| Gelatin | 0.890 g |
| Sodium polyacrylate, weight average molecular weight: 400000 | 0.023 g |
| 4-hydroxy-6-methyl-1,3,3a,7-tetraazindene | 0.015 g |
| 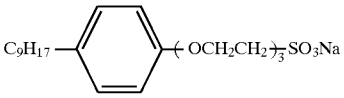 | 0.013 g |

-continued

| | |
|---|---|
| $C_{16}H_{33}O(OCH_2CH_2)_{10}H$ | 0.045 g |
| $C_{17}H_{33}CO-N(CH_3)-CH_2CH_2SO_3Na$ | 0.0065 g |
| $C_8F_{17}SO_2N(C_3H_7)-(CH_2CH_2O)_{15}H$ | 0.003 g |
| $C_8F_{17}SO_2N(C_3H_7)-(CH_2CH_2O)_4-(CH_2)_4SO_3Na$ | 0.001 g |
| 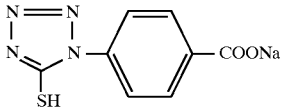 | 1.7 mg |
| 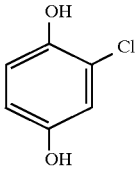 | 100 mg |
| Polymethylmethacrylate, average particle size 3.7 μm | 0.087 g |
| Proxsel, pH was adjusted to 7.4 by KOH | 0.0005 g |

Preparation of light-sensitive material 1

A biaxially stretched blue tinted polyethylene terephthalate support having 175 μm was subjected to a corona discharge treatment and the following subbing layers were coated on both sides of the support by a wire bar coater so that the coated amounts of the components were as follows, and dried for 1 minute at 185° C.

| | |
|---|---|
| Upper subbing layer | |
| Latex of butadiene/styrene copolymer (butadiene:styrene = 31:69 by weight | 0.322 g/$m^2$ |
| Sodium 2,4-dichloro-6-hydroxy-s-triazine | 8.4 mg/$m^2$ |
| $(n)C_6H_{13}OCO-CH_2$ / $(n)C_6H_{13}OCO-CH-SO_3Na$ | 1.29 mg/$m^2$ |
| 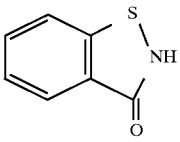 | 0.27 mg/$m^2$ |
| Lower subbing layer | |
| Gelatin | 300 mg/$m^2$ |
| Polyethylene acrylate | 20 mg/$m^2$ |
| $C_{12}H_{25}O(CH_2CH_2)O_{10}H$ | 4 mg/$m^2$ |

-continued

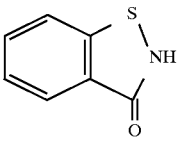

0.3 mg/m$^2$

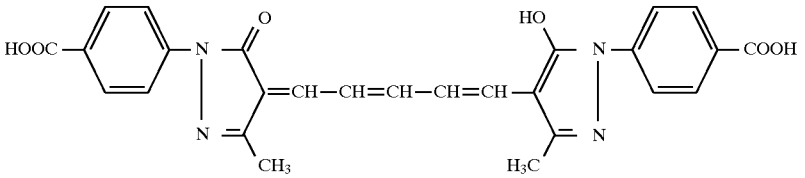

40 mg/m$^2$

The dye used in the above was a magnate dye and was added to a gelatin solution in a form of dispersion of micro crystals with an average particle diameter of 0.2 $\mu$m prepared by the following method. Twenty gram of the dye, 200 g of a 1% aqueous solution of carboxymethyl cellulose, 287 g of pure water were mixed and treated with zirconium oxide beads in an Eiger mill, manufactured by Eiger Japan Co., Ltd., at 5000 r.p.m. for 8 hours.

One side, side A, of the support on both sides of which the above subbing layers were provided, the above emulsion coating liquid 1 and the protective layer coating liquid, and on another side, side B, the emulsion coating liquid 2 and the protective layer coating liquid were coated to prepare Light-sensitive material 1. The coating amount of silver was 1.65 g/m$^2$ on each side of the support.

Preparation of Light-sensitive materials 2 and 3

Light-sensitive materials 2 and 3 were prepared in the same manner as in Light-sensitive material 1 except that the values of cross-over light controlled by changing the amount of the dye so that the values described in Table 2 were obtained, respectively.

Preparation of Light-sensitive materials 4 to 6

Light-sensitive materials 4 to 6 were prepared in the same manner as in Light-sensitive material 1 except that the values of contrast G were controlled by changing the mixing ration of emulsions A, B and C so that the values of G described in Table 2 were obtained, respectively <Processing condition>

The processing of the light-sensitive materials was carried out under the following condition: Automatic Processor SRX-503 manufactured by Konica Corp., SR-DF Developer and Fixer, a developing temperature of 35° C., a fixing temperature of 33° C., a washing temperature of 18° C. and a processing time for dry to dry of 45 seconds.

<Evaluation of combination of the light-sensitive material and the intensifying screen>

Determination of sensitivity

The light-sensitive material to be evaluated was placed between two sheets of the intensifying screen and exposed stepwise to X-ray generated by a X-ray source with 80 kVp. The exposure was controlled by changing the distance from the X-ray source to the light-sensitive material so that the difference of the exposure amount between a step to next step was Log E=0.15. Then the light-sensitive material was processed. The sensitivity of the light-sensitive material was determined by a reciprocal of exposure amount necessary for forming a density of $D_{min}$+1.0 in which $D_{min}$ was the minimum density of the processed light-sensitive material. The values of sensitivity described in the table were relative values based on the sensitivity of Experiment 1 which was set as 100.

Evaluation of the sharpness and granularity

The combinations of the light-sensitive material and the intensifying screen were each exposed imagewise to X-ray. The exposure was carried out by means of a X-ray source with 120 kVp on which an aluminum equivalent filter having 3 mm was attached, A breast phantom was placed at a distance of 140 cm from the X-ray source and a scattered ray preventing grid having a grid ratio of 8:1 was placed behind the phantom. The combination of the intensifying screens and the light-sensitive material to be evaluated was place behind the grid to exposed to X-ray. The light-sensitive material was processed after exposure. The exposure amount of X-ray was controlled by changing the exposing time so that the image density of at the portion of the highest density in the pneumonic field of the phantom was 1.8±0.5 in each of the light-sensitive materials to be evaluated. The sharpness and granularity of thus obtained images were visually evaluated according to the following norms.

Norm for evaluation of sharpness

A: Image is very sharp.

B: Image is clear but a little blur in the image is observed.

C: Image is blurred and image reading is hindered a little.

D: Image is notably blurred and

Norm for evaluation of granularity

A: Little granule of image is observed.

B: A little granule of image is observed.

C: Granule of the image notably observed and image reading is hindered a little.

D: Considerable granule of the image is observed and image reading is hindered.

Results of evaluation are shown in the following Table 2.

TABLE 2

| Evaluation No. | Light-sensitive material | Intensifying screen | Cross-over (%) | Contrast G | Sensitivity | Sharpness | Granularity | Note |
|---|---|---|---|---|---|---|---|---|
| 1 | 1 | 1 | 15 | 2.5 | 100 | C | C | Comp. |
| 2 | 1 | 2 | 15 | 2.5 | 130 | B | C | Inv. |

TABLE 2-continued

| Evaluation No. | Light-sensitive material | Intensifying screen | Cross-over (%) | Contrast G | Sensitivity | Sharpness | Granularity | Note |
|---|---|---|---|---|---|---|---|---|
| 3 | 1 | 3 | 15 | 2.5 | 150 | B | BC | Inv. |
| 4 | 1 | 4 | 15 | 2.5 | 125 | B | C | Inv. |
| 5 | 1 | 5 | 15 | 2.5 | 150 | BC | BC | Inv. |
| 6 | 2 | 1 | 10 | 2.5 | 98 | BC | CD | Comp. |
| 7 | 2 | 2 | 10 | 2.5 | 125 | AB | C | Inv. |
| 8 | 2 | 3 | 10 | 2.5 | 145 | B | BC | Inv. |
| 9 | 2 | 4 | 10 | 2.5 | 120 | A | C | Inv. |
| 10 | 2 | 5 | 10 | 2.5 | 145 | B | BC | Inv. |
| 11 | 3 | 1 | 18 | 2.5 | 102 | CD | C | Comp. |
| 12 | 3 | 2 | 18 | 2.5 | 135 | C | C | Comp. |
| 13 | 3 | 3 | 18 | 2.5 | 155 | C | BC | Comp. |
| 14 | 3 | 4 | 18 | 2.5 | 130 | C | C | Comp. |
| 15 | 3 | 5 | 18 | 2.5 | 155 | CD | BC | Comp. |
| 16 | 4 | 1 | 10 | 2.15 | 110 | BC | C | Comp. |
| 17 | 4 | 2 | 10 | 2.15 | 145 | AB | BC | Inv. |
| 18 | 4 | 3 | 10 | 2.15 | 165 | B | B | Inv. |
| 19 | 4 | 4 | 10 | 2.15 | 140 | A | B | Inv. |
| 20 | 4 | 5 | 10 | 2.15 | 165 | B | AB | Inv. |
| 21 | 5 | 1 | 10 | 1.60 | 112 | BC | BC | Comp. |
| 22 | 5 | 2 | 10 | 1.60 | 148 | AB | B | Inv. |
| 23 | 5 | 3 | 10 | 1.60 | 170 | B | AB | Inv. |
| 24 | 5 | 4 | 10 | 1.60 | 145 | A | B | Inv. |
| 25 | 5 | 5 | 10 | 1.60 | 170 | B | AB | Inv. |
| 26 | 6 | 1 | 10 | 1.40 | 112 | C | BC | Comp. |
| 27 | 6 | 2 | 10 | 1.40 | 148 | B | B | Inv. |
| 28 | 6 | 3 | 10 | 1.40 | 172 | BC | AB | Inv. |
| 29 | 6 | 4 | 10 | 1.40 | 148 | B | B | Inv. |
| 30 | 6 | 5 | 10 | 1.40 | 175 | BC | AB | Inv. |

It is understood from the above results that an image excellent in the sensitivity and the image quality, sharpness and granularity, can be obtained by the radiographic image forming method of the invention. It is further understood that the image quality is further improved within the range of the contrast G of 1.5 to 2.2.

What is claimed is:

1. A radiographic image forming method comprising interposing a silver halide photographic material between two sheets of an intensifying screen, said photographic material comprising a support with a silver halide emulsion layer on each side and having a crossover value not exceeding 15%, each of said intensifying screens comprising a support, a fluorescent layer, and a protective layer on said fluorescent layer, said fluorescent layer including a plurality of sub-layers, each of which comprises a binder and particles of a fluorescent substance having an average particle size R and a standard deviation σ of particle size distribution satisfying the relation $$O<\sigma/_R\leq 0.5$$

one of said sub-layers having a largest R value and another of said sub-layers having a smallest R value, said largest R value being from 10 μm to 20 μm and said smallest R value being from 1 μm to 5 μm.

2. The method of claim 1, wherein the radiographic image has a contrast G of from 1.5 to 2.2.

* * * * *